United States Patent [19]

Williams

[11] 4,050,624

[45] Sept. 27, 1977

[54] ONE-PIECE BOX WITH TAPERED SIDES AND METHOD OF MAKING SAME

[76] Inventor: Donald F. Williams, 15 West Mason St., P.O. Box 1527, Santa Barbara, Calif. 93102

[21] Appl. No.: 528,448

[22] Filed: Nov. 29, 1974

Related U.S. Application Data

[63] Continuation of Ser. No. 287,045, Sept. 7, 1972, abandoned, which is a continuation-in-part of Ser. No. 241,320, April 5, 1972, abandoned, which is a continuation-in-part of Ser. No. 163,789, July 19, 1971, abandoned.

[51] Int. Cl.[2] ..... B65D 5/22

[52] U.S. Cl. ..... 229/33; 229/44 R; 229/31 R

[58] Field of Search ..... 229/33, 36, 44 R, 30; 220/31 S

[56] References Cited

U.S. PATENT DOCUMENTS

| | | | |
|---|---|---|---|
| 1,420,001 | 6/1922 | Wagner | 229/33 |
| 2,527,167 | 10/1950 | Wauda | 229/36 |
| 2,964,228 | 12/1960 | Cote et al. | 229/33 |

*Primary Examiner*—George E. Lowrance

*Assistant Examiner*—Douglas B. Farrow

*Attorney, Agent, or Firm*—Wm. Jacquet Gribble

[57] ABSTRACT

A one-piece box blank is cut from a single sheet with creases and score lines dividing the box blank into a receptacle section, a hinge section and a cover section. The cover and receptacle sections both have side and front flaps. The front flaps and hinge section are proportioned such that the receptacle front flap is not totally overlapped by the cover front flap when the box is closed. The depth of the receptacle side flaps adjacent the hinge section is less than the depth of the hinge section. The spaced, scored fold lines separating the side flaps from the cover and the receptacle sections are straight lines, converging from the front flap of the cover to the front flap of the receptacle. If the box is wrapped corner notches are preferably cut in both the one-piece box blank and in a one-piece wrap. The wrap and the blank are combined as they pass through a conventional wrapping machine. When the wrap and box blank are in tray configuration in the wrapping machine, the hinge cuts are incised in either the wrap or in both the wrap and the box blank by added machine components. In the closed box the partially exposed receptacle front flap affords an overlying cover flap edge for opening the box.

11 Claims, 23 Drawing Figures

INVENTOR.
DONALD F. WILLIAMS

BY

W. J. Gribble
ATTORNEY

INVENTOR.
DONALD F. WILLIAMS

BY

W. J. Gribble
ATTORNEY

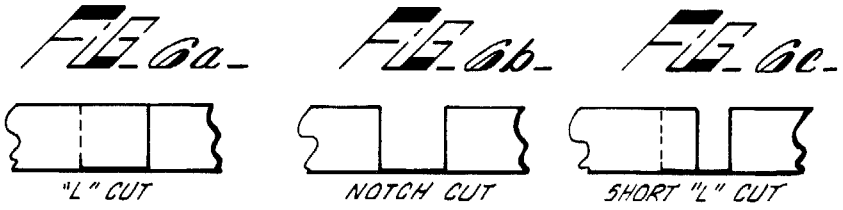
FIG. 6a.
FIG. 6b.
FIG. 6c.
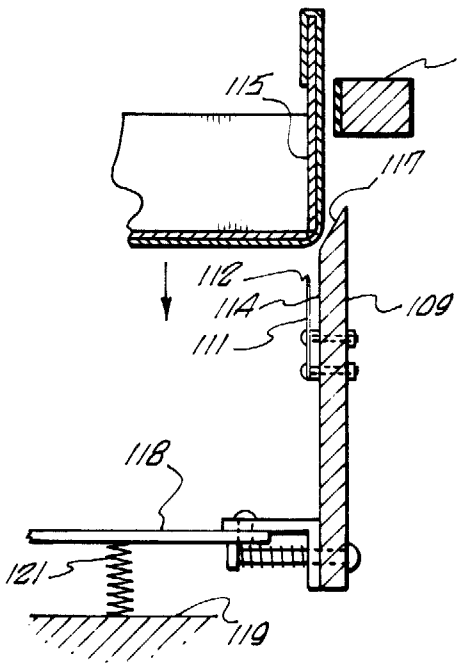
FIG. 8.
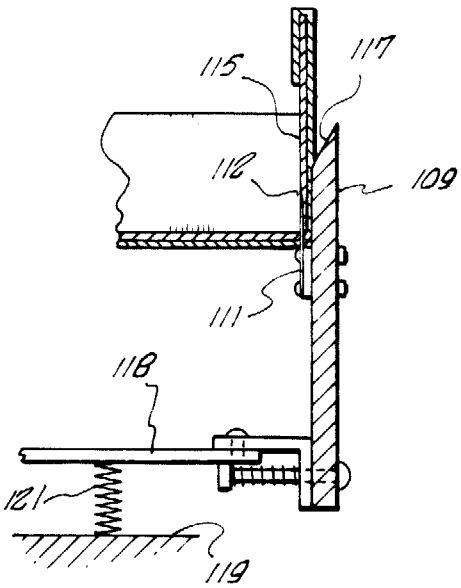
FIG. 9.
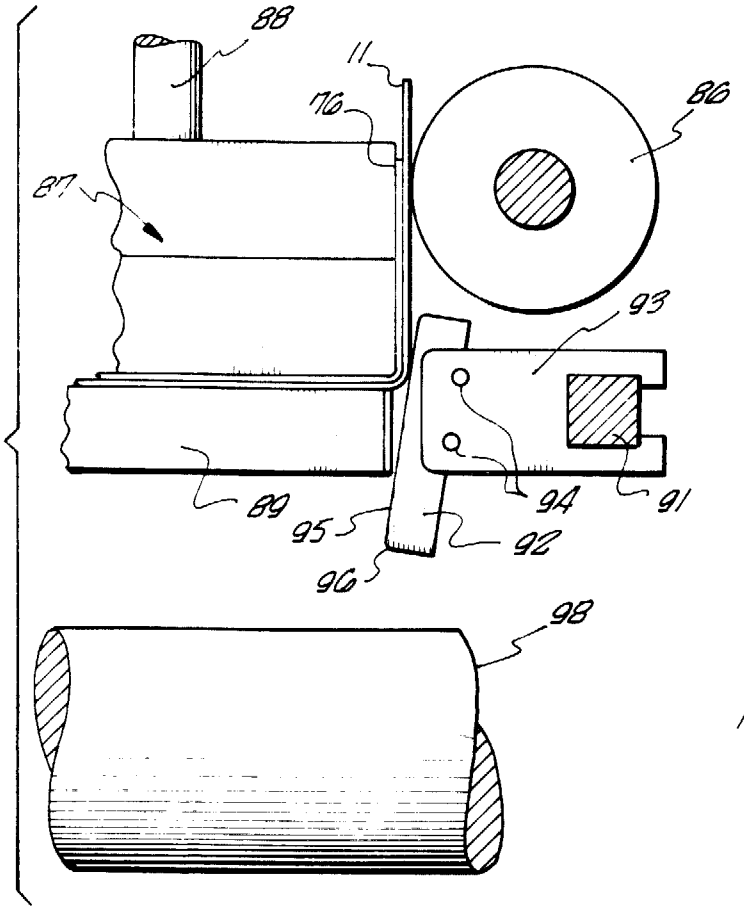
FIG. 7.

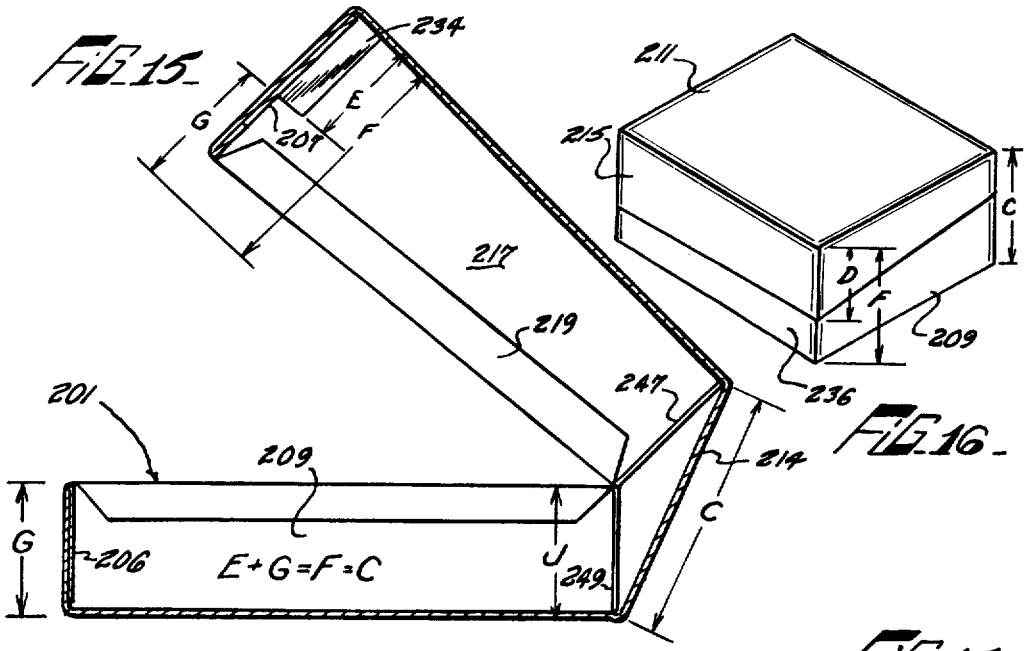
FIG. 15
234
G
E
F
207
217
219
247
214
C
201
209
G
206
E+G=F=C
J
249
FIG. 16
211
215
C
D
F
209
236
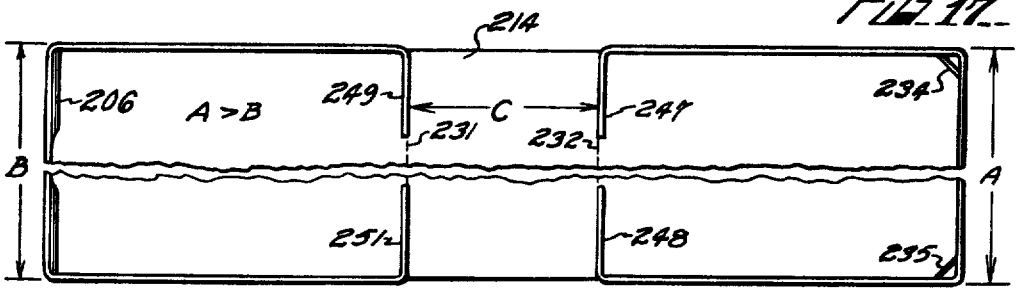
FIG. 17
214
206
A>B
249
C
247
234
231
232
B
A
251
248
235
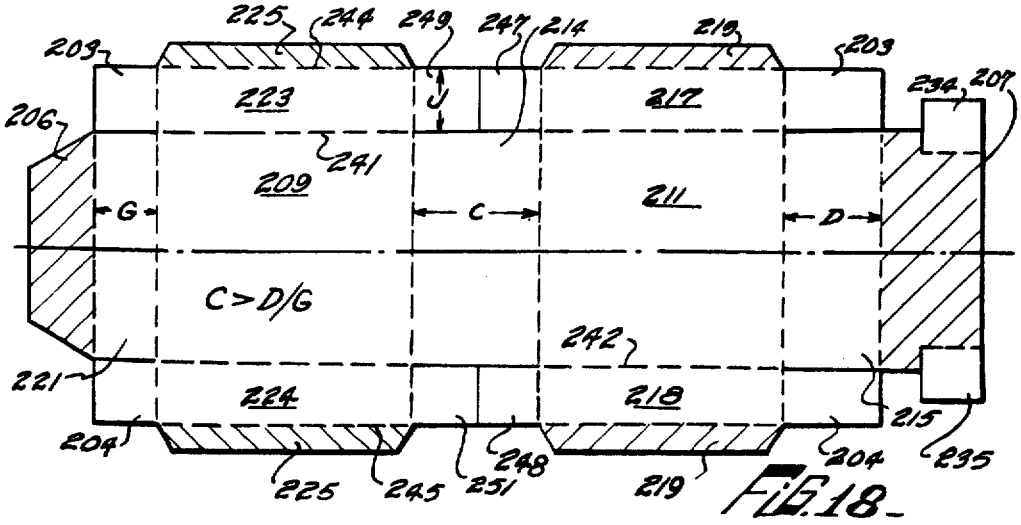
225
244
249
247
214
219
203
203
223
J
217
234
207
206
241
209
211
G
C
D
C>D/G
242
221
224
218
215
204
204
235
225
245
251
248
219
FIG. 18

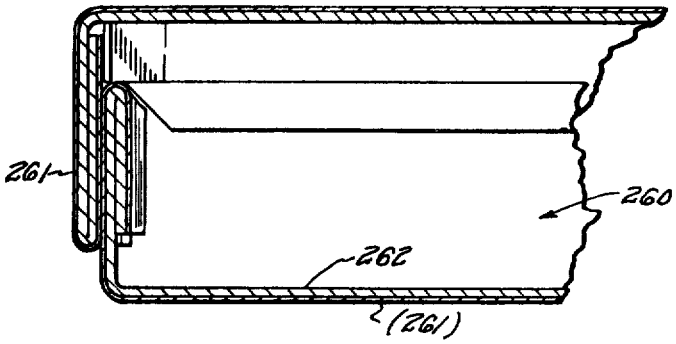
FIG. 19
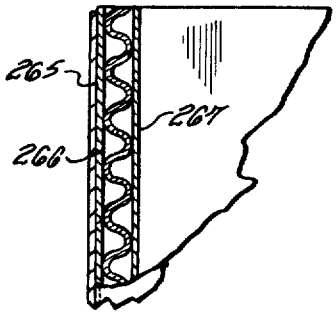
FIG. 20
FIG. 21
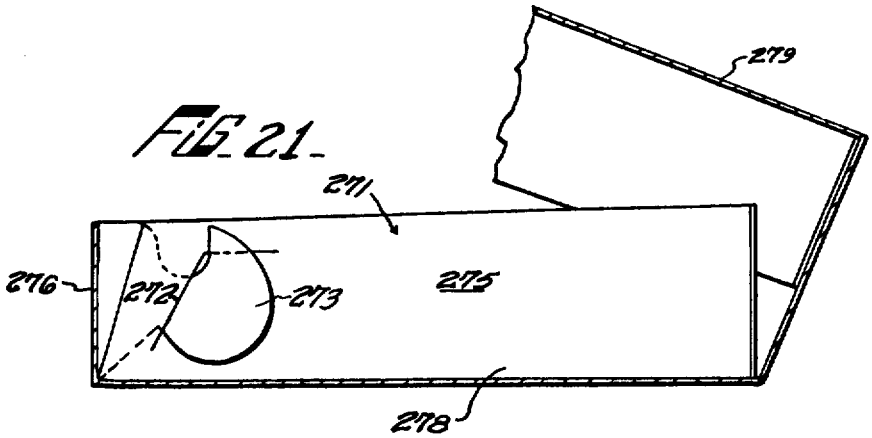

ONE-PIECE BOX WITH TAPERED SIDES AND METHOD OF MAKING SAME

Related Applications

This is a continuation of application Ser. No. 287,045 filed Sept. 7, 1972, now abandoned which was a continuation-in-part of application Ser. No. 241,320 filed Apr. 5, 1972, now abandoned, and entitled "Wrapped Box With Tapered Sides and Method of Making Same," which in turn is a continuation-in-part of my application of the same title filed July 19, 1971, Ser. No. 163,789, now abandoned.

BACKGROUND OF THE INVENTION

The invention relates to one-piece boxes of cardboard and the like and more particularly to rigid boxes folded from a single sheet. The invention application is to folding and rigid, glued or wrapped (stayed or unstayed) boxes. U.S. Pat. No. 1,420,001 issued to J. Wagner, deceased, on June 20, 1922 and entitled "Folding Pasteboard Box," illustrates the general field of the invention for the wrapped style. A second patent issued to Wagner the same date, U.S. Pat. No. 1,420,000, entitled "Pasteboard Box and Wrapper" further sets forth a wrapping technique.

The Wagner box configuration accomplishes the size differential between cover and receptacle necessary for the cover to encompass the receptacle in simple fashion. However, Wagner and other similar one-piece boxes need a separate cutting operation to create thumb notches in the cover in order to open the box and to indicate which side to open when the cover and receptacle overlap. In the case of wrapped boxes some prior boxes have required special tooling adjustment of the wrapping machinery, and unconventional notching of the wrap corners and hinge sections. The wrapping machinery must also be adjusted in such boxes for the staggered line outer flap edges about which the wrap must be folded to its interior fastening place. Also, no simple provision for positioning the cover in various display attitudes has previously been known.

I have invented a one-piece folded box, and method and apparatus for its fabrication, which obviates these difficulties in simple fashion with little alteration of present box-making equipment.

SUMMARY OF THE INVENTION

The invention contemplates a one-piece box which comprises receptacle, cover and hinge wall sections, with the hinge wall connecting the cover and receptacle. Score lines define side margins on the sections. Preferably each side margin on each of the cover and receptacle is aligned with the complementary side margin of the other section to converge toward the hinge wall in the cover and away from the hinge wall in the receptacle. A front flap extends from each of the cover and receptacle sections. The front receptacle flap may differ in depth from the front cover flap. A side flap extends from each side margin of the cover and from each side margin of the receptacle. The depth of the receptacle side flaps adjacent the hinge section is less than the depth of the hinge section. In one embodiment the side flaps increase in depth oppositely to the taper of the side margins of the cover and receptacle. In other embodiments the side flaps are defined by outer lines more divergent from or parallel to the side margins of the cover and receptacle. Preferably a wrap is adhered to the side and front flaps and covers all other exterior surfaces, although laminar, coated, printed or plain blanks may be substituted for plain blanks plus wrappers.

The method of the invention contemplates a process for making a wrapped one-piece folded box including steps whereby a box blank is formed in accordance with the characteristics set forth above. A complementing wrapping blank may also be formed. The box blank and wrapping blank are carried together through conventional box-forming machinery by the machine wrapper form wherein the flaps of the box blank are upset and the wrap is upset about the flaps and folded inwardly and downwardly and adhered to the now interior faces of the box blank to define an open tray. As the tray progresses cutters carried by portions of the wrapping machinery incise vertical cuts through the wrap and cutters fixed relative to the wrapper form plunger motion through the machine incise horizontal cuts through the wrap to define the hinge cuts or notches for folding the box from tray configuration to closed configuration. The vertical slits may be made by either rotary cutters on the rollers or the wrapper frame, or by elongate blades carried by conventional horizontally reciprocating portions of the wrapping machinery which move inwardly toward the rollers during the conventional wrapping process.

Incising blades carried by the conventional components of the wrapping machine may be configured to make the standard notch, "L," short "L" or "T" cuts, or incise two slits.

In an alternative embodiment of the method of the invention, the hinge notches or other hinge cuts are not precut in the box blank but are incised within the wrapping machine at the same time that the wrap is incised to form the hinge notch in the wrap.

It is an object of the invention to provide a one-piece rigid box wherein both cover and receptacle portions have converging side margins and the side flaps of the portions are defined outwardly each by a single straight line.

It is a further object of the invention to provide a one-piece box wherein the front flap of the cover portion, the front and side flaps of the receptacle portion and the hinge wall depth are proportioned to provide relief of receptacle side flap upward pressure on the closed cover, an indicator of the openable side of the box and afford a means for opening the box without the necessity of incising a thumb notch.

It is an additional object to provide such a box especially suited to display its contents.

It is also an object of the invention to provide a one-piece box wherein the configuration of the box flaps and cover and receptacle portions is such that the production machine need only be conventionally adjusted in its configuration in order to accomplish completion of the inventive box.

It is a further object of the invention to provide a method and apparatus for incising the wrap or the wrap and box blank on conventional wrapping machinery at the time the combination of the wrap and the box blank is accomplished.

The invention may be embodied in a box formed into tray configuration by a Brightwood type machine from either laminated, printed or coated blanks of cardboard or plastic or the like.

Die cut blanks of suitable material of Beers style, simplex style or other folding cartons generally supplied in knock-down form may be fabricated in a straight line folding box gluer. Boxes of web corner style, wrapped or not, may embody the invention. Boxes in accordance with the invention may be made by cutting blanks in lock corner style for flat shipping for set up by the user at the point of use.

The invention affords a one-piece box which is functional, economical, practical and attractive and which can be made on standard rigid and folding box machinery with little or no alteration beyond customary adjustments.

These and other advantages of the invention are apparent from the following detailed description and drawing.

Figure 10:
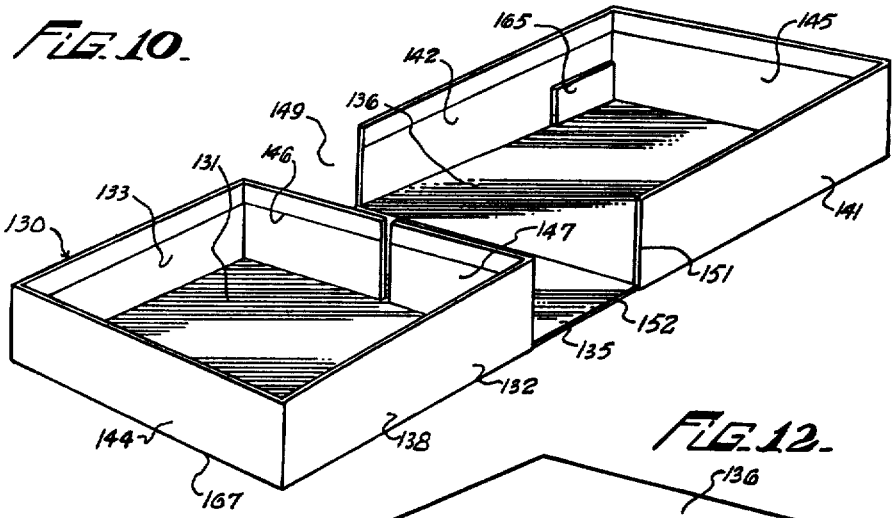
Figure 12:
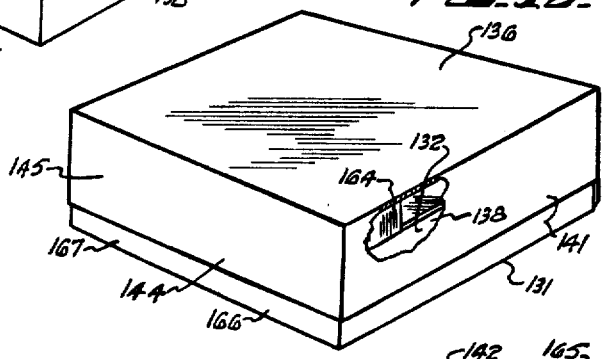
Figure 11:
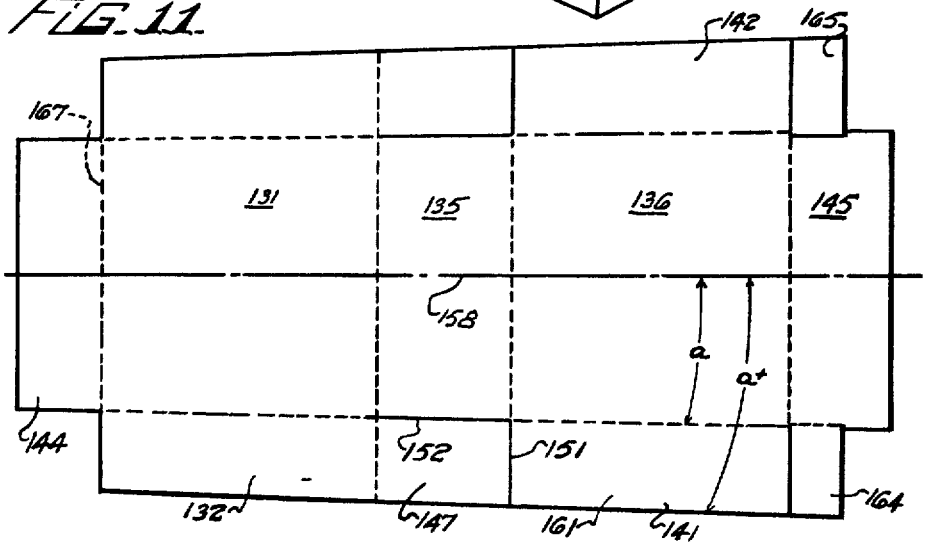
Figure 13:
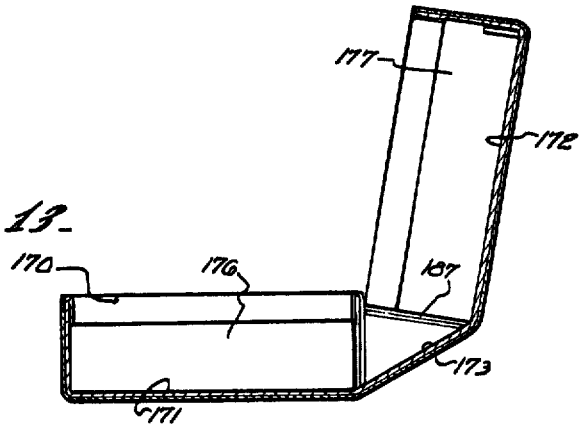
Figure 14:
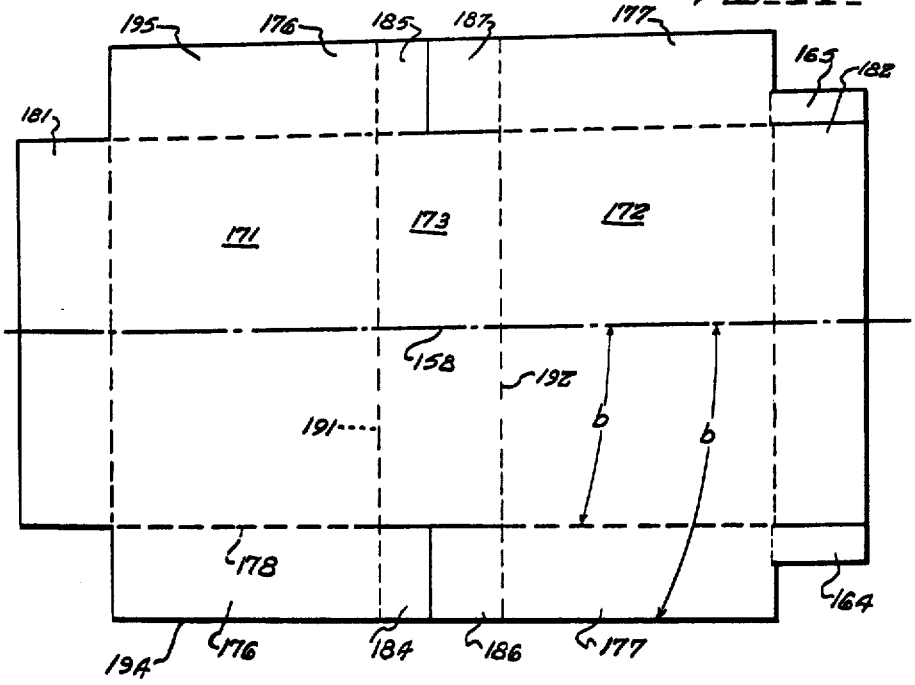

FIGS. *6a, 6b* and *6c* show conventional hinge area cuts;

FIG. 7 is a fragmentary schematic section illustrating the method of the invention whereby a vertical slit is cut in the wrap;

FIG. 8 is a fragmentary schematic section illustrating the method of incising a horizontal slit in the wrap of the box of the invention;

FIG. 9 is a fragmentary schematic section illustrating the second position of the incising operation for horizontal slits;

FIG. 10 is a perspective view of a display box in accordance with the invention;

FIG. 11 is a lay-out of a blank for the box of FIG. 10;

FIG. 12 is a perspective view of the box of FIG. 10 in closed attitude;

FIG. 13 is a longitudinal cross-section of a further alternate embodiment of a one-piece display box;

FIG. 14 is a lay-out of a box blank for the box of FIG. 13;

FIG. 15 is a sectional elevation of a Brightwood style box made in accordance with the invention in display configuration;

FIG. 16 is a perspective view of the box of FIG. 15 in closed position;

FIG. 17 is a plan view of the box of FIG. 15 in tray configuration;

FIG. 18 is a lay-out of the box blank of the box of FIG. 15;

FIGS. 19 and 20 are fragmentary sectional views of alternate embodiments; and FIG. 21 is a fragmentary view of a further alternate embodiment in lock-corner style.

Like reference characters are used for like parts in the various views.

Definitions: "rigid box" refers to that style of box which is three-dimensional, that are noncollapsible and delivered to the customer for product loading in a fully erect state. "Folding box" refers to boxes supplied in knock-down form or blanks. When erected they become three-dimensional rigid packages with cover and receptacle attached together.

DESCRIPTION OF THE PREFERRED EMBODIMENTS

WRAPPED BOXES

Figure 1:
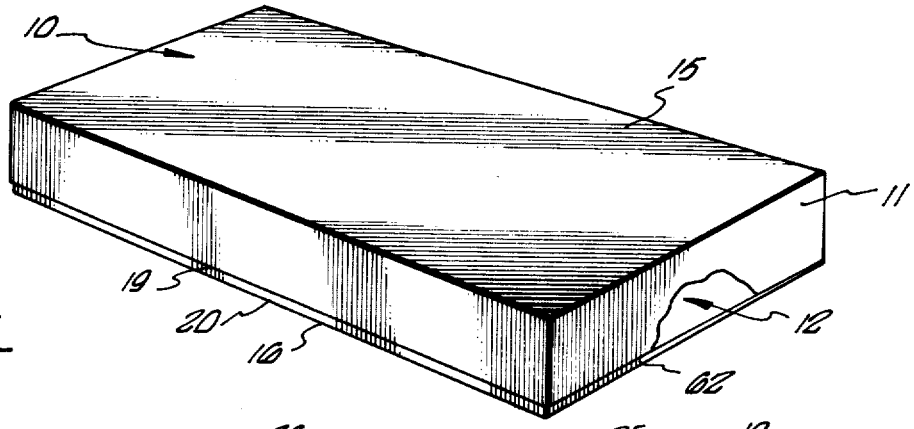
FIG. 1 is a perspective front view of a closed wrapped box in accordance with the invention.
Figure 2:
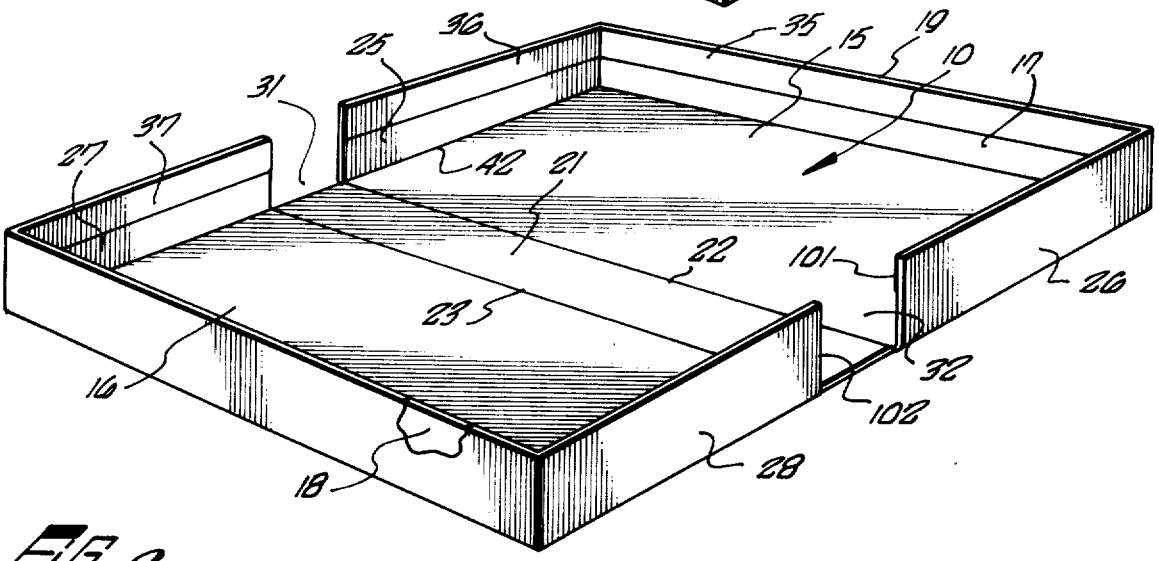
FIG. 2 is a perspective front view of the box of FIG. 1 in tray configuration.
Figure 3:
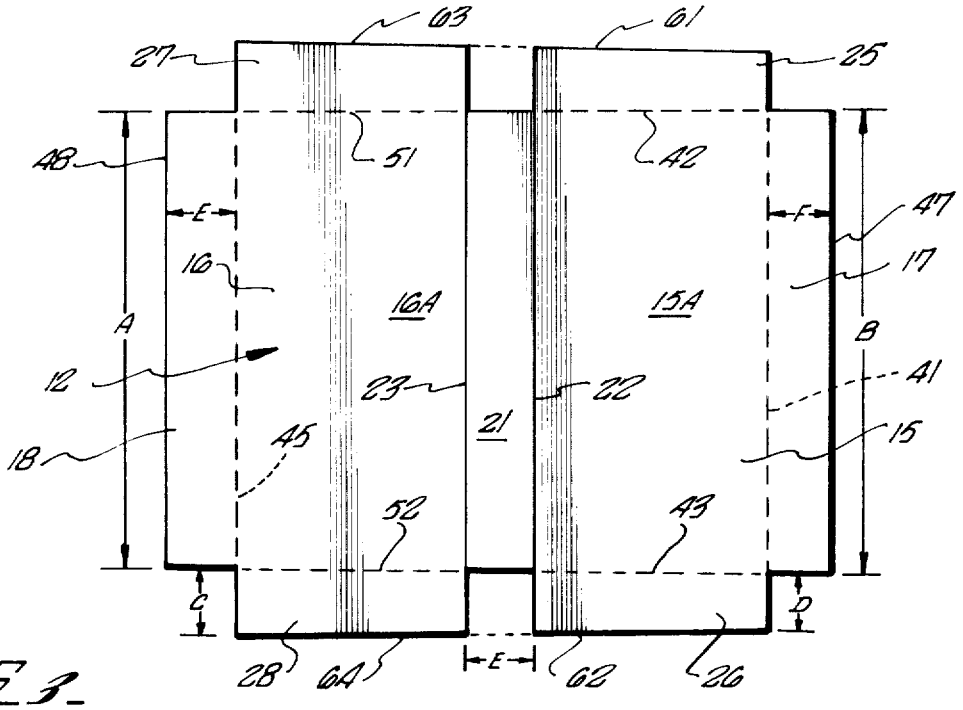
FIG. 3 is a view of the one-piece box blank from which the box of FIG. 1 is fabricated.
Figure 4:
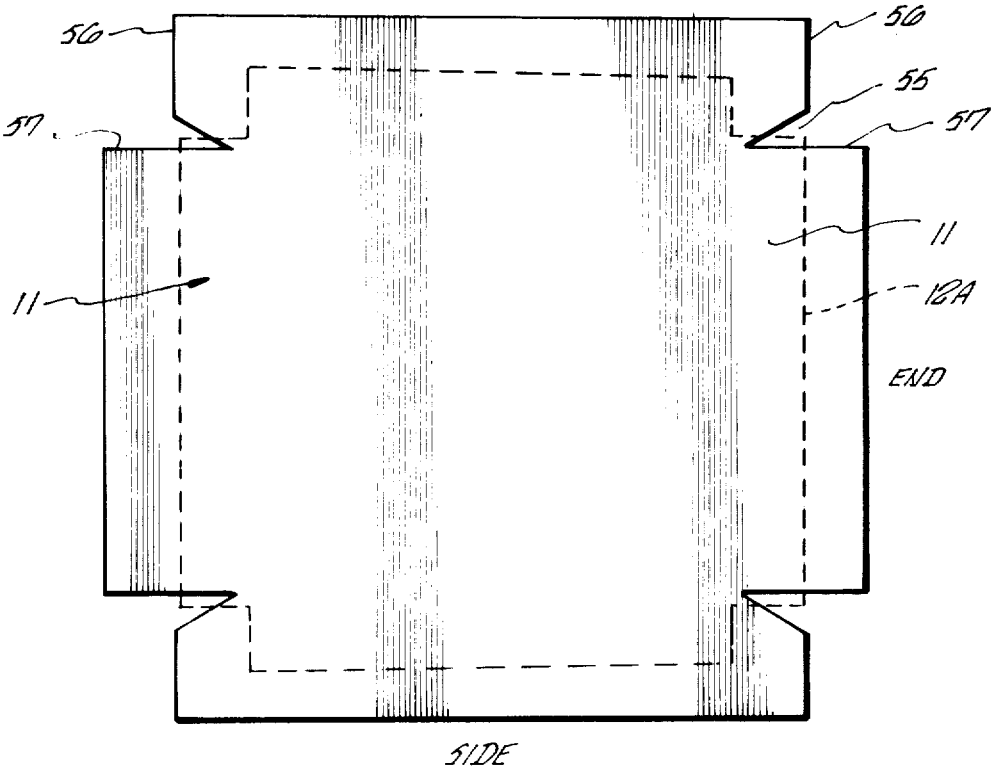
FIG. 4 is a view of the flap wrap of the box of FIG. 1.

In FIGS. 1 and 2 a one-piece wrapped box 10 has an outer wrap 11 which is shown in blank form in FIG. 4. The cardboard box 12 is shown in blank form in FIG. 3. In FIGS. 1 and 2 the wrapped box has a cover portion 15 and a receptacle portion 16 which have front flaps 17 and 18, respectively. Flap 17 has a lesser depth than flap 18 such that the closed box, as shown by FIG. 1, presents a distinctive edge 19 and an exposed receptacle flap area 20 which serve both to indicate the open side of the box and afford means to open the box without a thumb cut-out.

The cover and receptacle portions 15 and 16, respectively, are divided by a hinge portion 21 separated from the cover and receptacle by hinge creases 22, 23. The hinge creases are parallel and extend across the cover and receptacle portions. The cover has side flaps which are upstanding in FIGS. 1 and 2 and are identified by reference characters 25, 26. The receptacle has side flaps which are upstanding in FIG. 2 and identified by the numerals 27, 28. Side flaps 25, 27 are separated by a hinge notch 31 and side flaps 26, 28 are separated by a hinge notch 32. Wrap 11 is folded over the aligned upper edges of the side flaps and over the front flaps and downwardly into the tray defined by the flaps in overlapping folds such as the folds 35, 36, 37, which are adhered to the side and front flaps to hold the wrap in place. Conventional wrapping machines properly fold the wrap at each of the corners of the tray during its fabrication so that the wrap holds the side and front flaps in proper orientation to define the box tray without the necessity of staying the corners.

While the box may be fabricated without stayed corners, the invention does not preclude the use of a stayed box form beneath the wrap.

The wrap may be printed in conventional fashion to indicate the box contents and source, and to be decorative.

In FIG. 3 the box 12 is shown in flat blank. The cover portion 15 comprises the lid 15A and its marginal flaps, such as the cover front flap 17 and opposed side flaps 25, 26. The width of the flap 17 is indicated by the dimension B. Hinge portion 21 is separated from the cover by hinge crease 22. A score line indicated by the dotted line 41 separates the cover from its front flap 17. Score lines 42, 43 define the juncture of lid 15A and side flaps 25, 26.

Receptacle portion 16 comprises a bottom 16A divided from the front receptacle flap 18 by a score line 45. The width of the flap 18 is indicated by dimension A. Bottom 16A is separated from hinge portion 21 by the crease 23. Preferably the outer edges 47, 48, respectively, of the cover and receptacle front flaps 17 and 18 are mutually parallel and parallel to score and crease lines 41, 45 and 22, 23.

Side flaps 27, 28 of the receptacle portion are divided from bottom 16A by score lines 51, 52, respectively. The box blank shown in FIG. 3 is combined with the wrap 11 shown in FIG. 4 and processed by a wrapping machine. During that process the side and front flaps are bent upwardly along the score lines to form a tray in which lid 15A, hinge portion 21 and bottom 16A are coplanar. The bending is conventionally accomplished by spaced roller pairs. It is therefore desirable that score lines 42, 51 and 43, 52, for instance, be straight lines and aligned in pairs so that the roller for each side need not be staggered nor the upsetting of the tray be done in stages. As can be seen from FIG. 3, score lines 42, 51 define a straight line, as does the score line pair 43, 52. The lines of the two sides converge from flap 17 to flap 18 so that dimension B exceeds dimension A.

FIG. 4 illustrates the flap form of the wrap 11 with the box blank configuration shown in dotted lines 12A upon the wrap. The wrap has a V-shaped corner notch 55 at each corner in addition to the right-angle corner edges 56, 57 at each blank corner.

As the box and wrap proceed through the conventional wrapping machine the wrap and the side flaps are first upturned by passage through parallel rollers along opposed sides of the box and wrap. The corner folds are made and the wrap is then folded inwardly and downwardly at the outer edges 71, 72, 73, 64 of each of the side flaps 25–58. In order for the machine rapidly and smoothly to accomplish the further folding over of a the folded portions, such as the portions 36, 37 of FIG. 2, the side flap outer edges 71, 63 and 62, 64 should define straight lines. In the blank of FIG. 3, therefore, edges 61, 63 are aligned, as are edges 62, 64.

Cutting a thumbnotch is an additional step in conventional boxmaking usually performed after the wrapped tray is moved from the wrapping machine. The invention eliminates the need for the thumb notch by providing a front cover flap 17 which has a dimension F which is less than the dimension E of front receptacle flap 18. As can be seen from FIG. 1, the folded box thereby presents an opening edge 19 and an exposed receptacle flap area 20 which indicates the end of the box which opens.

As can be seen from FIG. 1, the outer edges 62 of cover side flap 26 indicates by the marginal exposure of the receptacle flap 28 which end of the box opens. In order for the telescoping of the cover over the receptacle to be such that receptacle flaps are also exposed at each end, the depth D of the side flaps of the cover is less than the similar depth C of the side flaps of the receptacle. The line of the edges 72, 64 of the side flaps is therefore not parallel to the center of the box nor to the line defined by score lines 43, 52.

The front flaps 17, 18 of the cover and receptacle differ in width, as mentioned above and as indicated by the dimensions A and B. When the box is closed, as shown in FIG. 1, the side flaps 61, 62 of the cover must telescope over the side flaps 63, 64 of the receptacle. For this reason the score lines converge toward flap 18 in an amount such that dimension B exceeds dimension A by approximately twice the thickness of the box and wrap material. The snugness with which the cover fits the receptacle may be adjusted by predetermination of the difference between dimensions A and B. The difference between the dimensions C and D, with C being the larger, is determined by the increment of exposure desired for the receptacle flaps below the outer edges of the cover flap edges. The box appearance and the effective indication of the open side of the box is enhanced when dimension C exceeds dimension D by an amount exceeding the difference between dimensions A and B. The outer configuration of the box blank of FIG. 3 is thus such that the lines of the side flap outer edges converge in a direction opposite to the convergence of the side flap score lines. So long as the lesser dimension D exceeds the depth of the overlapping folds, such as the folds 36, 37, the conventional wrapping machine makes a smooth union between the wrap and the box blank.

Figure 5:
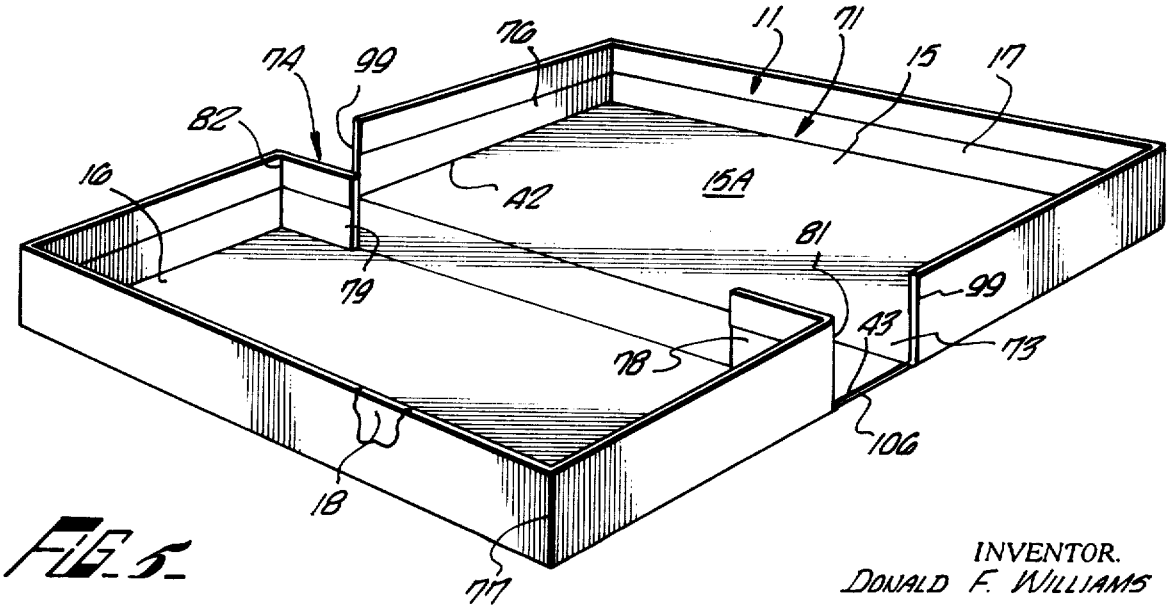
FIG. 5 is a perspective view of an alternate embodiment of the invention shown in tray configuration and having inward anti-spill flaps.

The embodiment of FIGS. 1–4 has a notch cut as exemplified by the notches 31, 32 of FIG. 2. In the embodiment of FIG. 5, a one-piece wrapped box 71 has L-cut notches 73, 74. In other respects the box of FIG. 5 is identical to the box of FIG. 1, having a cover portion 15 and a receptacle portion 16, each with front flaps 17 and 18, respectively. A wrap 11 similar to the wrap of FIG. 4 has been applied to the box blank 76 which has side flaps and score lines made in accordance with the teaching with respect to the embodiment of FIG. 1. Thus the front flap 18 has a greater depth than the cover front flap 17 and the outer edges of the side flaps of the box of FIG. 5 converge oppositely to the score lines 42, 43 which separate the side flaps from the lid 15A of the cover.

As is the case with the previously described embodiment, a box of neater finished configuration is achieved if the dimension C (FIG. 3) is equal to the dimension E and the dimension F is equal to the dimension D. With a blank so configured the adjoining flap corners, such as the corner 77 of FIG. 5, are not staggered at the outer edges.

The L-cut notches 73, 74 of FIG. 5 result in a tab, such as the tabs 78, 79 which are hinged at 81 and 82, respectively, to extend inwardly and afford means for restricting outward motion of any articles in the box when the cover 15 is displaced from the receptacle 16. The tabs also hold the ends of the side flaps of the receptacle in correct vertical position and give the hinge portion a firm base to rest against while it is being closed. The cover thereby fits down and stays down properly after it is closed. Since the outer edges of the side flaps converge or taper oppositely to the score lines, the turned inward flap is slightly shorter than the depth of the hinge portion, and this permits the lid to close over it properly.

The hinge notches 73, 74 may be cut at the time the box blank is formed but alternatively may be cut at the same time the wrap is cut in accordance with the method of the invention: when the combined wrap and blank are assembled in the wrapping machine.

THE METHOD

The method of the invention and one apparatus to perform the method are disclosed in FIGS. 7, 8 and 9. The conventional components of a wrapper machine are shown schematically and fragmentarily, the construction of such wrapping machines being well known in the art. Conventional machines, such as the Stokes and Smith machine, can easily be modified by the addition of notch-cutting elements without changing the conventional components of the machine.

In FIG. 7 the right roller 86 of the wrapping machine upper roller pair is shown guiding the box blank 76 and the wrapper 11 between the roller pair and the components of the wrapper form 87. After the united wrapper and blank are placed in the wrapping machine a plunger, such as the plunger 88, impels the blank and wrapper between the upper rollers to upset the side flaps of the blank and the wrap about the vertical wall of the wrapper form component. The lower wrapper form block 89 supports the lid and receptacle bottom as the box passes through the rollers.

A motivating bar 91 for the conventional corner lap plate of the wrapping machine supports an attached vertical blade 92. The bar is conventionally reciprocated horizontally during the wrapping process. The support means for the blade varies with the particular wrapping machine but in the case of the Stokes and Smith machine, a simple slider support 93 secures the blades by means of fasteners 94. Alternatively, blade supports may be fastened to the reciprocating side roller frame. Blade edge 95 is at a slight angle to the vertical such that the cut successively deepens as the box traverses the machine vertically. Bottom corner 96 of the blade is spaced with respect to the travel of the wrapper forms 87 such that the corner cuts a shallow groove in the form such that the forms may pass without interference. The corner lap plate bar reciprocates horizontally in accordance with the travel of the wrapper forms in proper sequence such that the blade does not interfere with upward travel of the wrapper forms after the forms leave the lower pair of rollers (such as roller 98) which upturn the front flaps of the cover and receptacle.

In the case of the L-cut of the box of FIG. 5, the blade 92 accomplishes the cut along the edge 99 of the notch at the hinge line. A pair of horizontally spaced blades like the blade 92 accomplish the cutting of the hinge notch edges 101 and 102 such as in the conventional notch cut 32 of the embodiment of FIG. 1.

FIGS. 8 and 9 illustrate the process for cutting through the wrap or through the wrap and box along the score line edge 106 of a box like the box of FIG. 5. The method and cut are the same for the square notch cut, the L-cut or for the short L-cut (FIG. 6). The latter notch cut requires a second vertical blade on the bar 91 vertically oriented between the crease lines 22, 23 of the hinge portion, for instance, rather than at the crease lines as for FIG. 6*b*.

As can be seen from FIG. 8, the upset box and wrap, in tray configuration continue downwardly through the wrapping machine. Directly below the conventional presser block 108 of the wrapping machine at either side of the box path is an upstanding blade holder 109. FIG. 8 shows the blade holder on one side of the box only. A horizontally extending blade 111 has a horizontal cutting edge 112. Edge 112 is spaced from an inner guide surface 114 of the blade holder an increment equal to the combined thicknesses of the wrap and box blank such that the blade position on cutting coincides with an inner wall 115 of the upturned side flap of the box blank. A downwardly and inwardly sloping face 117 on the blade holder guides the blade into proper orientation with respect to the space of the side flap. The blade holder 109 is spring-mounted to a frame 118 which is supported from a convenient machine portion 119 by one or more override springs 121. The springload is sufficient to resist displacement of the frame downwardly until blade edge 112 has penetrated the wrap or the box blank and then the continuing downward motion of the box overcomes the spring to lower the blade holder such that the blade penetration is controlled.

As shown in FIG. 9, the blade may be so adjusted as to penetrate both wrap and box to accomplish the hinge notching on a horizontal line of both the wrap and the box at the same time.

If the box blank has been notched at the time of shaping the passage of the blade upwardly through the notch has no harmful effect.

Boxes of specialized usage which can be made in accordance with the described process are shown in FIGS. 10–14, the box of FIGS 10, 11 and 12 being a shallow box suitable for display purposes and the box of greater relative depth.

Referring to FIG. 10, the display box 130 has a receptacle section 131 with side flaps 132, 133, a hinge section 135, and a cover section 136. The box is one piece and has an outer wrap 138 which is folded over the upturned edges of the side flaps 132, 133 of the receptacle, the side flaps 141, 142 of the cover and the front flaps 144, 145 of the receptacle and cover, respectively.

The wrap may also cover internal flaps 146, 147 which are folded inwardly from opposed hinge notches 148, 149 which result from L-shaped cuts having edges 151, 152 in each of the side flaps of the hinge secton 135. The receptacle section is thus closed to retain the material therein by the flaps 146, 147 even when the cover is lifted.

As is evident from FIG. 11, the side margins of the receptacle, hinge and cover sections are defined by straight lines indicated by the dotted lines 154, 155. The dotted lines are each a continuous straight line from the receptacle front flap 144 to the front flap 145 of the cover. The lines diverge from a central axis 158, a few degrees as indicated by the dimension *a*.

The outer edges of the side flaps on each side of the box are defined by straight lines 161, 162 which, in the case of the embodiment of FIG. 10, diverge from the central axis 158 a greater amount than do the fold line on each side of the receptacle and cover sections. The divergence is indicated by the dimension "*a* +." As a result of the greater divergence the cover front flap 145 has a greater depth than the receptacle front flap 144. In order for the box to make a presentable display the depth of the hinge section 135 is greater than the depth of the side flaps of the hinge section and its adjacent receptacle and cover sections. The cover front flap 145 is prevented from enveloping the front flap of the receptacle by stop tabs 164, 165, which rest upon the side flaps 132, 133 of the receptacle when the box is closed (FIG. 12), presenting a marginal area 166 adjacent the fold line 167 of the receptacle to indicate without the necessity of a thumb notch the side of the box which opens.

Because the sides of the receptacle section slope toward the front flap 144, making the receptacle shallower at its front, the box is well adapted to display purposes. The added hinge depth permits the cover to stand open such that the cover does not obscure the display.

In FIGS. 13 and 14 a display box 170 similar in many respects to the box of FIG. 10 is illustrated. The box is shown in longitudinal cross-section in FIG. 13 in display orientation. The box 170 has a receptacle section 171 and a cover section 172. The cover and receptacle sections are connected by a hinge section 173 having a greater depth than the side flaps, like flaps 176 of the receptacle and 177 of the cover.

As can best be seen from the blank lay-out of FIG. 14, the receptacle and cover sections are defined by diverging straight line indicated by the dotted fold lines 178, 179 which are concontinuously straight from the receptacle front flap 181 to the cover front flap 182. The side flaps of the hinge section are divided by a coventional T-cut into a pair of lesser inner flaps 184, 185 and greater arresting tabs 186, 187, with the former being attached to the receptacle side flaps and the latter being attached to the cover side flaps. The hinge fold lines 191, 192 extend transversely of the box blank such that the inner flaps and arrest tabs may be folded with respect to the side flaps.

The receptacle and the cover have side flaps of the same depth, since the straight line side margins 194, 195 of the side flaps diverge with respect to central axis 158 at the same angle "*b*" as do the side margins 178, 179 of the receptacle and cover sections. Stop tabs 164, 165 at the opposite edges of the cover front flap serve to limit the telescoping of the cover with respect of the receptacle such that a lower margin of front flap 181 of the receptacle is exposed as an indicator and aid to box opening without the necessity of a thumb notch.

As can be seen from FIG. 13, the arrest tabs, like tab 187, are folded inwardly and arrest the closing motion of the cover by their contact with the inner tabs 184, 185 to arrest the cover in display orientation, exposing the interior of receptacle section 171.

Each of the boxes of the embodiments of FIG. 10 and FIG. 13 is adapted to use as a display box while having the same advantages of fabrication and appearance as the previously described embodiments. The two display boxes may be made on conventional wrapping machines by the method and with the apparatus previously described with respect to the other inventive embodiments disclosed. The cutters for the vertical T-slits may be embodied in circular cutters affixed to the wrapping rollers. The cutters may be adjusted such that the cut is through the wrap only if the hinge slits or cuts are previously stamped in the blank prior to combination with the wrap, or may be so calibrated that they incise through the wrap and the box during passage of the combined box and wrap through the wrap and forming machine. While vertical slits both for hinge notching and for making arrest and inner flaps have been illustrated, the invention does not preclue diagonally vertical slits which can be made by various means, such as cutters with horizontal motion in a limited degree during the process of the box through the wrapper.

At the bottom of the plunger stroke the machine traverse of the wrapper forms is complete. The corner tucking and folding and the downward overlap of the wrap on the side flaps and front flaps, being well understood in the trade for this type of machine, are therefore not delineated in this disclosure.

The box is removed from the wrapping machine in tray configuration and is folded and telescoped into closed box shape at a later stage depending upon when the contents are added to the box.

While the added blade holders may vary in configuration when adapted to various wrapping machines, their method of operation remains the same, the blades making the vertical cut being moved into position with respect to the box by horizontal moving components of the machine and the blade making the horizontal cuts being guided to orient with respect to the downward travel of the box, as it progresses in conventional fashion through the wrapping machine. The blades for making the vertical cuts may alternatively be rotary or circular blades like those used in conventional scoring machines instead of straight-edged blades like those illustrated, especially to accommodate thicker box blank material.

Each of the inventive box embodiments disclosed herein including those made by the method set forth and by the implementing apparatus is a combination of elements such that each opens and closes with facility. The box element proportions are such that a marginal zone is exposed of the front flap of the receptacle when the cover is closed and box opening means is thus provided without the necessity of a thumb notch. Stop and arresting means not only accomplish the marginal exposure and also enable certain of the box embodiments to be utilized as display boxes. The relative proportions of the respective heights of the receptacle side flaps adjacent the hinge section, and the height of the hinge section, relieve upward pressure upon the cover tending to open it and the box closes and stays closed.

UNWRAPPED BOXES

The boxes of FIGS. 14–21 benefit also from the inventive combination which they share in common with the previously described embodiments. However, the boxes of FIGS. 15–21 need not be wrapped boxes. The embodiment of FIGS. 15–18 is like a Brightwood style box in that its corners are secured by tabs overlain by inward folds of the receptacle and cover section front flaps. While a Brightwood style has been shown, the invention does not preclude unwrapped boxes of Simplex, Beers, lock-corner, web corner or double-end wall and footlock styles, dependent upon the desired usage. The folded box 201 of FIGS. 15–18 is an unwrapped box. It may have an outer veneer either printed or otherwise applied for ornamentation. Thicknesses are exaggerated for pictorial clarity. Tabs, like the tabs 203, 204, are overlain by the front flap inward folds 206, 207 of both the receptacle section 209 and the cover section 211. Similarly, the aforesaid unwrapped box styles have corners remote from the hinge section secured in some convenient means when the box is erected for use. Unlike a wrapped box, the above set forth box types may be shipped to the customer flat, to be erected by the customer.

Box 201 has a receptacle section 209 and a cover section 211. A hinge section 214 joins the cover and receptacle sections. The cover section has a front flap 215 with said inward fold 207, as well as side flaps 217, 218. Each side flap has an inner fold 219. Likewise, the receptacle section has a front flap 221 with previously discussed inward fold 206, in addition to side flaps 223, 224 each with inward folds 225. The inward folds are shaded in FIG. 18.

In FIG. 17 the box is shown in tray configuration, corners secured, before being folded at hinge lines 231, 232 for closing. In that Figure, as in FIG. 15, corner arrests 234, 235 are visible. The arrests stop the cover section from completely enveloping the receptacle section, leaving an indicator zone 236 across the box front (FIG. 16) to show where the box opens.

FIG. 18, a flat lay-out of the box, shows the cover and receptacle sections defined by spaced score lines 241, 242 that are straight lines converging toward the blank center axis from the cover front flap toward the receptacle front flap. The marginal score lines 244, 245 that define the side flaps 217, 218 and 223, 224 may be straight lines or staggered lines, in accordance with the desired outer appearance of the closed box. In the instant embodiment the relationships of the flap depths and arrests are indicated on the drawing. Of particular note is that dimension "C" (the height of the hinge section) exceeds "J," the side flap height adjacent the hinge section, so that flap pressure on the cover which tends to resist closure is reduced or eliminated.

The cross-sectional view of FIG. 15 shows the embodiment of that invention in display configuration, the box being maintained partially open by the contact of inwardly folded cover arrest tabs 247, 248 with the side flaps of the receptacle section. When it is desired to close the box the arrest tabs 247, 248 are easily manipulated to a position behind the inward tabs 249, 251 of the receptacle section such that the cover can be closed to the configuration of FIG. 16. Arrests 234, 235 of the cover section then stop the cover short of complete envelopment of the receptacle section due to the relationship between the arrest height E, the cover front flap depth D and the receptacle front flap depth G. Preferably the E plus G sum is greater than D and appproximately equal to the hinge section height C such that the box forms a regular rectangle.

The depth or height C of the hinge section is greater than the height J of the receptacle side flaps adjacent the hinge section to avoid interference by the side flaps with the closing of the box and the maintenance of the closed position.

Since the box of FIG. 15 is not a wrapped box the blanks may be cut with more freedom and the alignment of the outer margins of the box blank is not as critical as with wrapped boxes.

FIG. 19 illustrates fragmentarily a box 260 which may be of Brightwood, Beers or other unwrapped folding box styling wherein the material from which the box blank is cut has a thin veneer which is a part of the box blank material. The veneer 261 is applied to the base material 262 prior to cutting the blank. The veneer may be plastic coating, printed color or other thin skin applied in suitable manner. Such a box may be cut and folded on a straight line gluer without the necessity of traversing a wrapping machine.

In FIG. 20 a further embodiment of a folded box is fragmentarily shown wherein the base material from which the box blank is cut has a corrugated core 265 with outer laminates 266, 267. Again the layers for the box blank are assembled prior to the cutting of the box blank and the passage of the blank through a straight-line gluer. The corrugations and the laminates may be plastic, paper or other common materials for forming a box with some rigidity.

In FIG. 21 a further embodiment of the invention is fragmentarily shown. A lock corner box 271 has a slot 272 and a lock tab 273 at each of the corners at the junctures of the side and front flaps 275, 276, respectively. The lock tabs overlap and fit in the slots of each corner to secure the corner in conventional erected condition. The box 271 may have a receptacle section 278, and a cover section 279, each of which have lock corner erecting means. Such boxes may be made in accordance with the invention, bringing the benefits of the invention to inexpensive boxes which may be shipped from the manufacturer in flat configuration and be easily erected by the user for filling.

Both the box of the invention and the method of the invention result in a superior box made on conventional equipment with very little modification of such equipment. The box of the invention is outstanding in appearance and is efficient in function at no extra cost in terms of box components.

Other modifications than those set forth herein within the scope of the invention will occur to those skilled in this art. It is therefore desired that the invention be measured by the appended claims rather than by the illustrative disclosure made herein.

I claim:

1. A one-piece folded box comprising a receptacle section having a bottom panel, a pair of spaced side flaps, a front flap and fold lines at the point of connection of said side flaps and front flap to said bottom panel; means fixing said front flap to said side flaps in folded and joined configuration at their mutual corners; a cover section having a lid panel, a pair of spaced side flaps, a front flap and fold lines at the point of connection of said side flaps and said front flap to said lid panel; means fixing said front flap and said side flaps in folded and joined configuration at their mutual corners; said side flaps of both said receptacle section and said cover section having a free edge opposite their respective fold lines; a hinge section including a hinge wall containing a pair of spaced fold lines each defining an active hinge, said hinge section connecting the receptacle and cover sections at said active hinges; means for reducing contact at closure between the cover and the receptacle side flaps to relieve that contact pressure resistance against maintaining proper closure of said cover section with respect to said receptacle section, said last-named means comprising receptacle side flaps having a substantial portion of the depth between said free edge thereof and the respective fold lines of the receptacle section less than the between the fold lines of said hinge section; and means for arresting the closing cover short of enveloping the front flap of the receptacle section, said means for arresting comprising a hinge section having a greater depth than either of the front flaps, and at least one stop tab having a fold line connected to any one of said flaps, said bottom panel and said lid panel.

2. A one-piece folded box comprising a receptacle section having a bottom panel, a pair of spaced side flaps, a front flap and fold lines at the point of connection of said side flaps and front flap to said bottom panel;

means fixing said front flap to said side flaps in folded and joined configuration at their mutual corners;

a cover section having a lid panel, a pair of spaced side flaps, a front flap and fold lines at the point of connection of said side flaps and said front flap to said lid panel;

means fixing said front flap and said side flaps in folded and joined configuration at their mutual corners; said side flaps of both said receptacle section and said cover section having a free edge opposite their respective fold lines;

a hinge section including a hinge wall containing a pair of spaced fold lines each defining an active hinge, said hinge section connecting the receptacle and cover sections at said active hinges;

and means for reducing contact at closure between the cover and the receptacle side flaps to relieve that contact pressure resistance against maintaining proper closure of said cover section with respect to said receptacle section wherein the means for reducing contact pressure comprises receptacle side flaps having a substantial portion of the depth between said free edge thereof and the respective fold lines of the receptacle section less than the depth between the fold lines of said hinge section.

3. A one-piece folded box in accordance with claim 2 further comprising means for arresting the closing cover short of enveloping the front flap of the receptacle section.

4. A box in accordance with claim 2 further comprising folding cuts incised in each side flap where said side flap is contiguous to said hinge wall.

5. A one-piece folded box in accordance with claim 2 further comprising means for arresting the closing cover short of enveloping the front flap of the receptacle section; and fold lines separating the respective flaps from the cover section and the receptacle section, the fold lines for the side flaps being straight lines when the box blank is flat converging from the cover section front flap to the receptacle section front flap.

6. A box in accordance with claim 3 wherein the means for arresting comprises a hinge section having a greater depth than the front flaps, and corner diagonal stop tabs on the cover.

7. A box in accordance with claim 3 wherein the means for arresting comprises a hinge section having a greater depth than the front flaps, corner diagonal stop tabs on the cover adjacent the front flap thereof, and arrest tabs on the cover adjacent the hinge section.

8. A box in accordance with claim 3 wherein the means for arresting comprises a front flap on the receptacle of greater depth than the front flap of the cover.

9. A box in accordance with claim 8 further comprising arrest tabs on the cover adjacent the hinge section.

10. In a box blank for a one-piece folded wrapped box having a receptacle section, a cover section, and a hinge wall connecting cover and receptacle sections, the combination comprising spaced side margins on each of the cover and receptacle sections converging toward the hinge wall in the cover and away from the hinge wall in the receptacle, a front cover flap, a front receptacle section flap of differing depth from the depth of the front cover flap, a side flap on each margin of the cover, a side flap on each margin of the receptacle section, said side flap ends matching the depth of the adjoining cover front flap and receptacle section front flap, and being cut on a straight line between said front flaps.

11. A box blank in accordance with claim 10 further comprising folding cuts incised in each side flap where said side flap is contiguous to said hinge section, said hinge section having a greater depth than the depth of the receptacle section side flap at its juncture with the hinge section.

* * * * *